US006305915B1

(12) United States Patent
Paddock et al.

(10) Patent No.: US 6,305,915 B1
(45) Date of Patent: Oct. 23, 2001

(54) SEALED STEADY BEARING ASSEMBLY FOR NON-METALLIC VERTICAL SUMP AND PROCESS PUMPS

(75) Inventors: Douglas Paddock, Penn Yan; Jeremiah Dennis Quill, Auburn; Teresa Ann Worczak, Canandaigua, all of NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/435,542

(22) Filed: Nov. 8, 1999

(51) Int. Cl.[7] ..... F04B 17/00; F04B 35/04
(52) U.S. Cl. ..... 417/423.12; 417/366
(58) Field of Search ..... 417/423.12, 356, 417/368, 423.8, 366

(56) References Cited

U.S. PATENT DOCUMENTS 3,816,020 * 6/1974 Ogles ..... 415/111
3,853,309 * 12/1974 Widmer ..... 266/41
4,815,184 * 3/1989 Johnston et al. ..... 29/156.8
5,494,413 * 2/1996 Campen et al. ..... 417/356

* cited by examiner

*Primary Examiner*—Teresa Walberg
*Assistant Examiner*—Thor Campbell
(74) *Attorney, Agent, or Firm*—Menotti J. Lombardi

(57) ABSTRACT

A bearing assembly for radially supporting a drive shaft of a pump such as a vertical sump and process pump. The bearing assembly has a bearing housing, a bearing having inner and outer surfaces, a bearing housing for holding the bearing, seals disposed in the housing for retaining a lubricant pumped into a space formed between the inner surface of the bearing and the drive shaft, and at least one water jacket disposed about a portion of the outer surface of the bearing. The water jacket circulates cooling liquid that contacts the outer surface of the bearing and carries away heat conducted through the bearing due to rotation of the drive shaft during operation of the pump.

20 Claims, 5 Drawing Sheets

10
13
54
55
12
11
14
17
15
55
51
20
52
16
19
53
18
59

SEALED STEADY BEARING ASSEMBLY FOR NON-METALLIC VERTICAL SUMP AND PROCESS PUMPS

FIELD OF THE INVENTION

This invention relates to non-metallic vertical sump and process pumps, and in particular to a steady bearing assembly for same that uses a sealed bearing supported in a non-metallic, corrosion resistant bearing housing.

BACKGROUND OF THE INVENTION

Steady bearing assemblies for non-metallic, vertical sump and process pumps are normally lubricated by a clean external source of liquid, usually water, or by delivery of product being pumped through a piping system from the pump's discharge. Steady bearing assemblies for metallic, vertical sump and process pumps are also normally lubricated by a clean external source or by product flush. A clean external source of cooling liquid, such as water, requires a delivery piping system and a control system to shut off the liquid when the pump is not running. Some of these metallic pumps employ a sealed bearing assembly that includes a bearing lubricated by grease introduced through external tubing. The grease is retained in the bearing by lip-style grease seals. Heat generated by the grease seals and by churning of the grease is carried away from the bearing through convective and conductive heat transfer through the metal housing and column pipe preventing excessive temperatures.

Both of these designs have inherent equipment, material, installation, and maintenance costs. For example, water lines installed in climates where the ambient temperature drops below freezing must be protected from freezing or the pump installed indoors which increases installation costs. If the liquid is not turned off, and continues to drain into the sump, the liquid will eventually have to be pumped out of the sump and treated which adds to maintenance costs. Product-flush bearing lubrication requires that the product be relatively clean, although sump applications can contain abrasive particles which can accelerate wear of the bearings and necessitate repeated and costly replacement. Various chemicals can be collected in waste sumps. If the chemicals are corrosive, e.g., hydrochloric acid, sulfuric acid, etc., the bearing assemblies must be fabricated using noble alloys to withstand the effects of these chemicals and yield a reasonable pump life. Noble alloys, such as Hastelloy B or C, Titanium, etc., can be very expensive and have long lead times as compared to non-metallic materials that can withstand the same chemicals.

Accordingly, there is a need for a steady bearing assembly that is less costly to build, install and maintain than conventional steady bearing assemblies.

SUMMARY OF THE INVENTION

A bearing assembly for radially supporting a drive shaft of a pump. The bearing assembly comprises a bearing housing, a bearing having inner and outer surfaces, a bearing housing for holding the bearing, seals disposed in the housing for retaining a lubricant pumped into a space formed between the inner surface of the bearing and the drive shaft, and at least one water jacket disposed about a portion of the outer surface of the bearing. The water jacket circulates cooling liquid that contacts the outer surface of the bearing and carries away heat conducted through the bearing due to rotation of the drive shaft during operation of the pump.

A pump comprising a pump assembly, a motor and mounting assembly, a drive shaft connecting the motor and mounting assembly to the pump assembly, and one or more of the bearing assemblies of the invention for radially supporting the drive shaft.

BRIEF DESCRIPTION OF THE DRAWINGS

The advantages, nature, and various additional features of the invention will appear more fully upon consideration of the illustrative embodiments now to be described in detail in connection with accompanying drawings wherein.

It should be understood that the drawings are for purposes of illustrating the concepts of the invention and are not necessarily to scale.

DETAIL DESCRIPTION OF THE INVENTION

Figure 1:
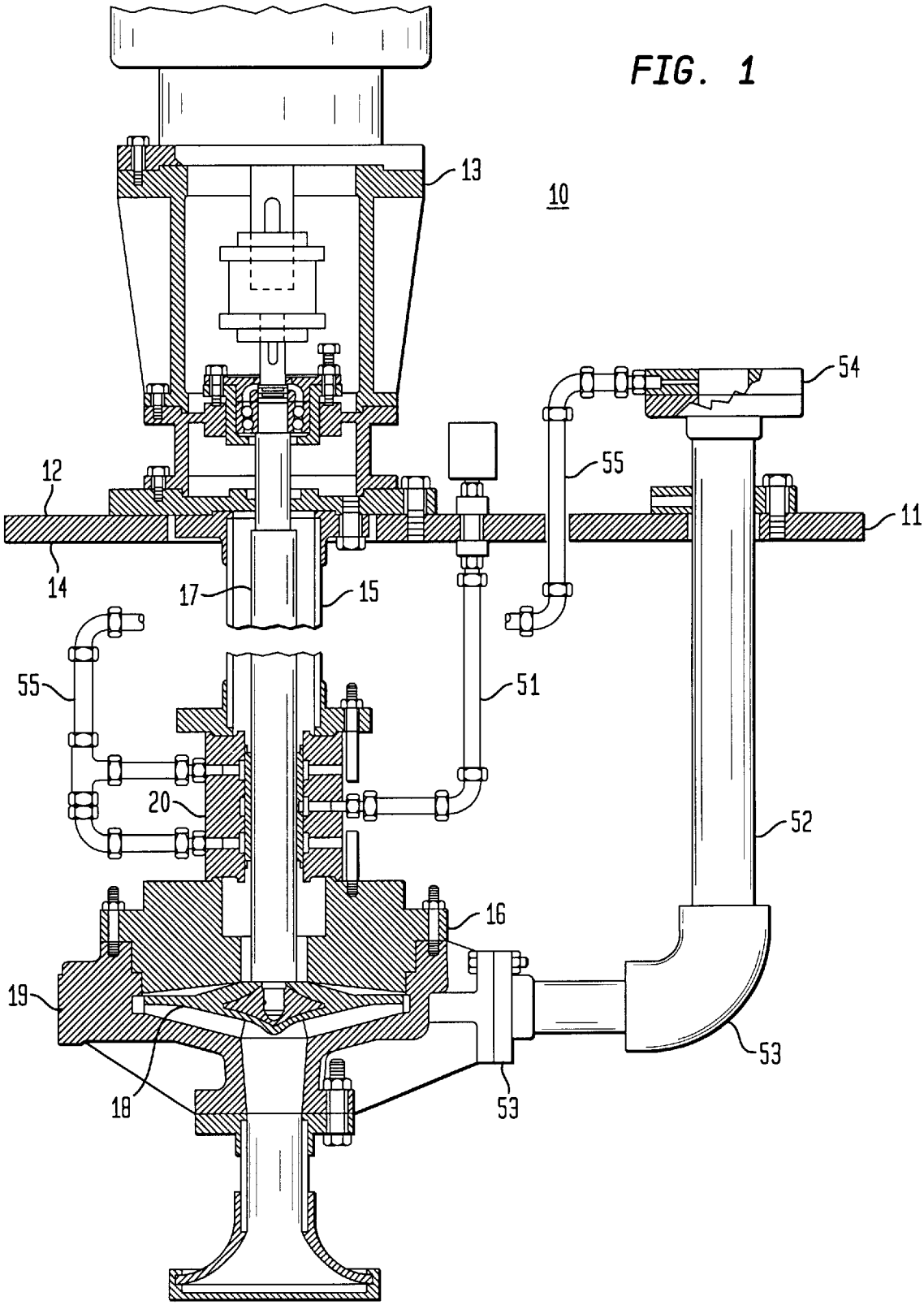
FIG. 1 is a partially sectioned elevational view of a sealed steady bearing assembly of the invention mounted directly on a non-metallic, vertical sump and process pump.

FIG. 1 shows a sealed steady bearing assembly 20 made according to the invention, as typically used in a pump 10 such as a non-metallic, vertical sump and process pump. The pump 10 includes a mounting plate 11 having an upper surface 12 which mounts a motor and mounting assembly 13, and a lower surface 14 which mounts in in line order a cylindrical column pipe assembly 15, the bearing assembly 20 and a pump assembly 16. A drive shaft 17, extending through the mounting plate 11, and column pipe and bearing assemblies 15, 20, couples the motor and mounting assembly 13 to a pump impeller 18 disposed in an impeller casing 19 of the pump assembly 16. Fluid pumping is achieved by means of the motor and mounting assembly 13 which when energized, produces high speed rotation of the impeller 18 via the drive shaft 17 which couples the impeller 18 to the motor and mounting assembly 13. The steady bearing assembly 20, which is typically disposed between the pump assembly 16 and the column pipe assembly 15, radially supports the drive shaft 17 and impeller 18, and thus, reduces radial movement thereof. This in turn prevents the impeller 18 from contacting the impeller casing 19. Although only one steady bearing assembly 20 is shown in use with the pump 10 of FIG. 1, it should be understood that additional steady bearing assemblies 20 can be employed in the pump 10 depending upon the length of the column assembly 15 and drive shaft 17. Moreover, the steady bearing assembly 20 can be mounted directly on the pump assembly 16 as shown in FIG. 1 or between various sections of the column assembly 15.

Figure 2:
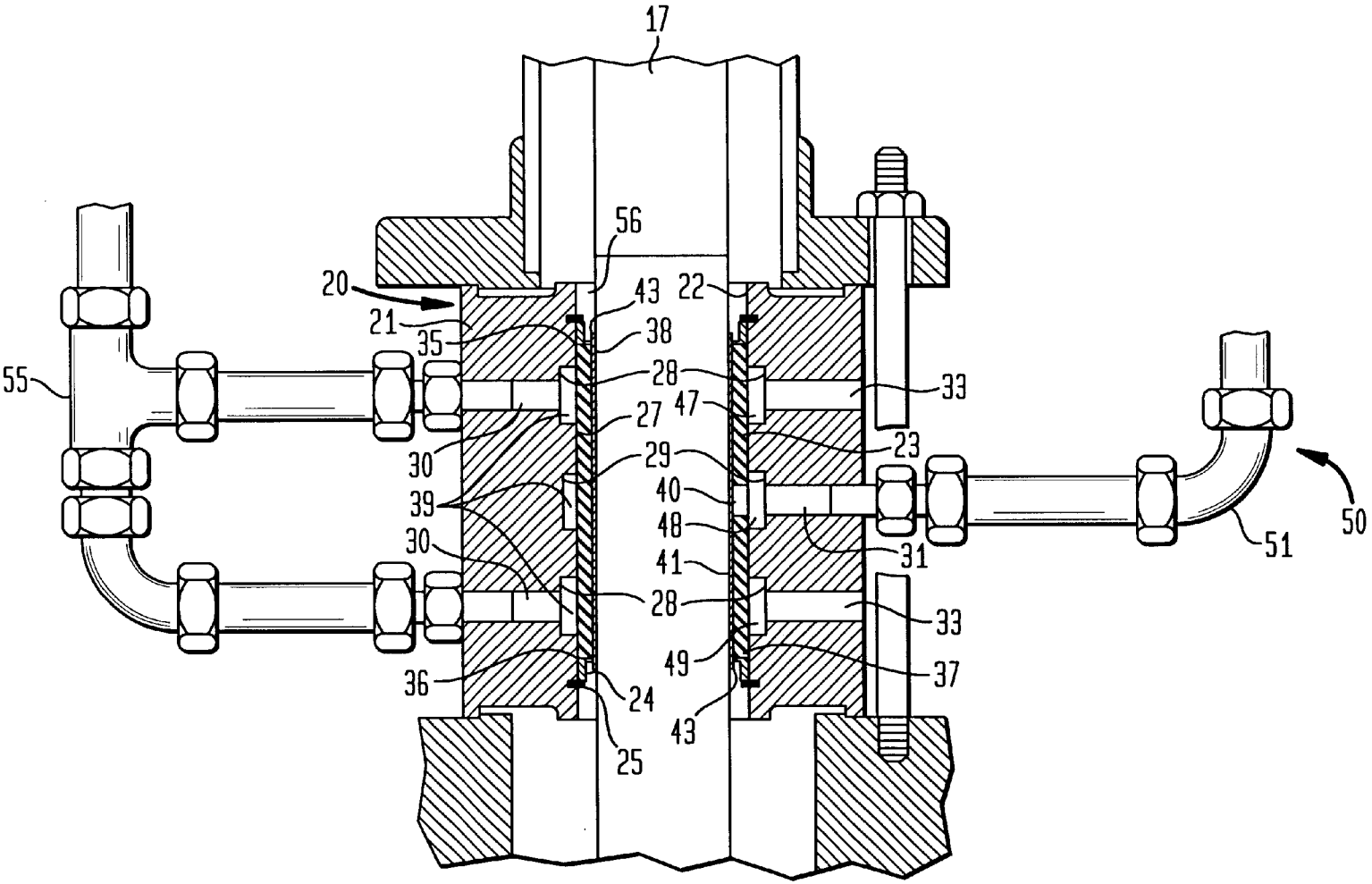
FIG. 2 is an enlarged, partially sectioned elevational view of the sealed steady bearing shown in FIG. 1.

FIG. 2 shows the steady bearing assembly 20 separate from the pump 10. The steady bearing assembly 20 typically includes a bearing housing 21 having an axially extending open ended bore 22, a generally cylindrical shape bearing 23 disposed in the bore 22, and a grease seal 24 and retaining clip 25 arrangement disposed at each end of the bearing 23.

Figure 3A:
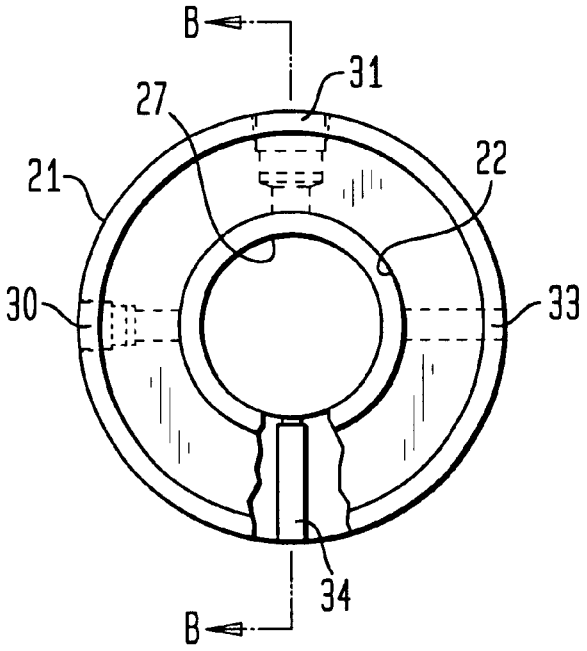
FIG. 3A is a partially sectioned plan view of a bearing housing typically used in the sealed steady bearing of the invention.
Figure 3B:
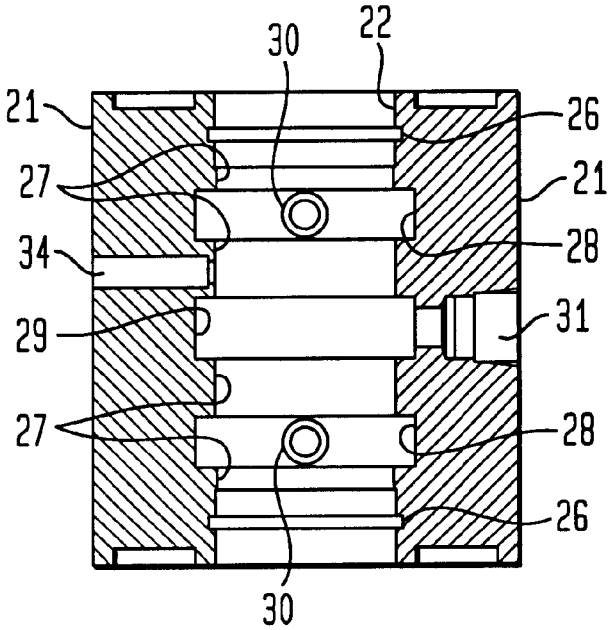
FIG. 3B is a sectional view through line B—B of the bearing housing shown in FIG. 3A.

As shown collectively in FIGS. 3A and 3B, the axial bore 22 of the bearing housing 21 has a generally circular cross section and a diameter which is greater than that of the drive shaft 17. The bore 22 includes a pair of annular recesses 26 for seating the retaining clips 25 in the bore 22, and a raised, generally cylindrical bearing land surface 27 disposed between the recesses 26 for mounting the bearing 23. The bearing land surface 27 includes two outer annular grooves 28 separated by an inner annular groove 29. A first group of orifices having two outer inlet orifices 30 and an inner inlet orifice 31, extend through the bearing housing 21 at a first location. The outer inlet orifices 30 each open into a corresponding one of the outer annular grooves 28. The inner inlet orifice 31 of the first group opens into the inner annular groove 29. A second group of orifices including two outlet orifices 33 (FIG. 3A & FIG. 2) extend through the bearing housing 21 at a second location. Each outlet orifice 33 opens into an associated one of the outer annular grooves 28. A pin aperture 34 extends through the bearing housing 2l at a third location and opens into the bearing land surface 27.

The bearing housing 21 can be fabricated from any suitable corrosion resistant non-metallic or metallic material. However, in order to take full advantage of the cost saving features of the invention, the bearing housing 21 is preferably made from a non-metallic material such as fiberglass reinforced polyester because it is significantly less expensive than noble metal alloys typically used for fabricating corrosion resistant metallic-based bearing housings.

Figure 4A:
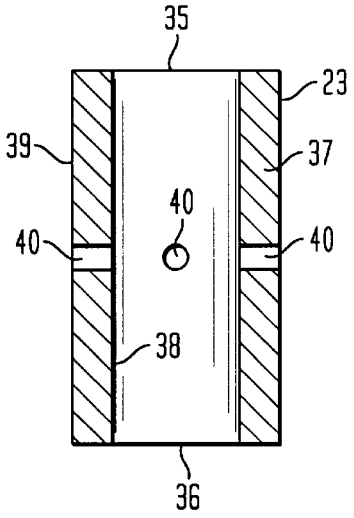
FIG. 4A is a sectional view of a bearing typically used in the sealed steady bearing of the invention.
Figure 4B:
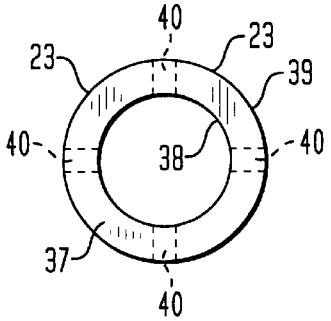
FIG. 4B is a plan view of the bearing shown in FIG. 4A.

FIGS. 4A and 4B collectively show the bearing 23 of the steady bearing assembly 20. The bearing 23 has a generally cylindrical wall 37 extending between first and second open ends 35, 36 thereof. The wall 37 of the bearing has an inner surface 38 (contact grease lubrication surface), an outer surface 39 (contact cooling liquid surface), and one or more apertures 40 extending through an intermediate section of the wall 37 between the inner and outer surfaces 38, 39. The bearing is typically fabricated from carbon or any other suitable bearing material.

Figure 5A:
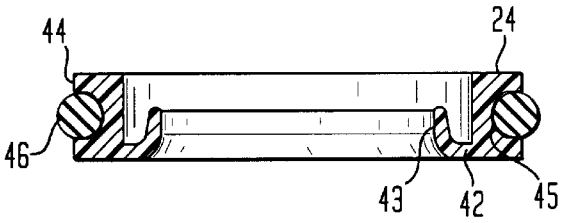
FIG. 5A is a sectional view of one of the two grease seals typically used in the sealed steady bearing of the invention.
Figure 5B:
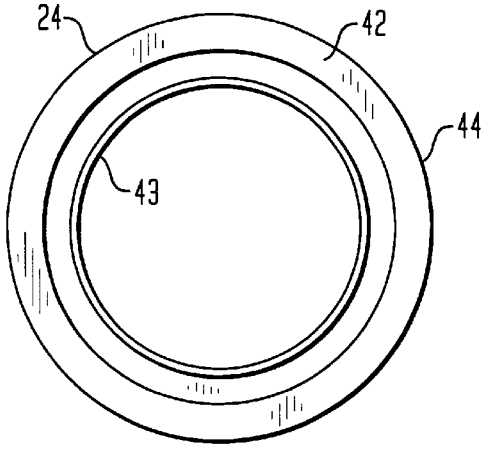
FIG. 5B is a plan view of the seal shown in FIG. 4B.

FIGS. 5A and 5B collectively show one of the two grease seals 24 used in the steady bearing assembly 21. Each grease seal 24 has a ring-like body 42 with an inwardly projecting curved sealing lip 43 or flange. The seal 24 is preferably made from a non-metallic, corrosion resistant material such as a graphite filled PTFE. The outer peripheral surface 44 of the body 42 includes a slot 45 that houses an elastomeric O-ring 46.

Figure 6A:
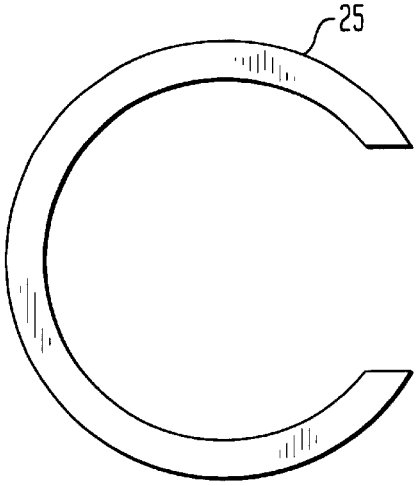
FIG. 6A is a plan view of one of the two retaining clips typically used in the sealed steady bearing of the invention.
Figure 6B:
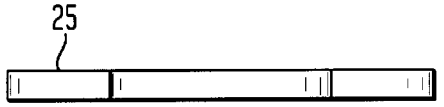
FIG. 6B is an elevational view of the retaining clip shown in FIG. 6A.

FIGS. 6A and 6B collectively show one of the retaining clips 25 used in the steady bearing assembly 20. Each retaining clip 25 is C-shaped, and fabricated from a corrosion resistant metallic material or preferably a non-metallic material such as PTFE, that provides the clips 25 with a spring like character. This enables the retaining clip 25 to firmly engage the axial bore recess 26 when installed therein.

Referring again to FIG. 2, the components of the steady bearing assembly 20 interact as follows. A cylindrical space 41 is provided between the inner surface 38 of the bearing 23 and the outer surface 56 of the drive shaft 17 to allow forced delivery of a lubricating grease. The outer surface 39 of the bearing 23 closes off the annular grooves 28, 29 defined in the bearing land surface 27 thereby forming three annular spaces 47, 48, 49 about the outer surface 39 of the bearing 23. A grease line tube assembly and grease pump cup arrangement 50 (FIG. 1) communicates with the cylindrical space 41 by way of a passageway formed by the inner inlet orifice 31, the inner annular space 48 defined between the inner annular groove 29 and the bearing wall 37, and the apertures 40 in the bearing wall 37. The grease seals 24 disposed at the ends 35, 36 of the bearing 23 in the axial bore 22 are positioned so that the free ends of their sealing lips 43 face away from the ends 35, 36 of the bearing 23 to seal off the cylindrical space 41 to prevent the escape of grease from therein and also to prevent liquid and abrasive particles from entering. The retaining clips 25 disposed in the annular recesses 26 (visible in FIG. 3B) retain the grease seals in the axial bore 22 of the bearing housing 21. The two outer annular spaces 47, 49 operate as cooling jackets around the bearing 23 to remove heat therefrom by circulating pumped cooling liquid supplied from the pump assembly's discharge via a piping system 52 that includes a discharge pipe assembly 53, flush spacer 54, and internal tube flush assembly 55 (FIG. 1). The pumped cooling liquid in the outer annular spaces 47, 49 contact the outer surface 39 of the bearing 23 and carry away heat conducted through the bearing wall 37 that has been generated by fiction between the grease seals 24 and rotating shaft 17, and by viscous churning of the grease in the cylindrical space 41 defined between the inner bearing surface 38 and the outer surface 56 of the drive shaft 17. A pin (not shown) disposed in the pin aperture 34, engages the outer surface 39 of the bearing 23 to prevent it from spinning relative the bearing housing 21.

As should now be apparent, the sealed steady bearing assembly 20 of the invention realizes cost advantages of non-metallic pumps which employ conventionally lubricated non-metallic steady bearing assemblies and metallic pumps which employ conventionally sealed metallic steady bearing assemblies. In particular, sealing features of the bearing assembly 20 substantially prevent pumped cooling liquid from entering the cylindrical space 41 and contacting the inner bearing surface 38 and the outer drive shaft surface 56 thus, abrasives in the pumpage can not infiltrate the bearing assembly 20 and caused accelerated wear. The water cooled bearing feature of the bearing assembly 20 advantageously allows the bearing housing 21 to be constructed from relatively inexpensive non-metallic corrosion resistant materials like fiberglass reinforced polyester (FRP). Non-metallic materials act more like insulators than conductors of thermal energy. Consequently, the bearing assembly 20 of the invention provides a method for removing heat and preventing the internal bearing temperature from exceeding the temperature limits of the bearing housing material. Metallic steady bearing assemblies rely solely on the expensive metallic corrosion resistant composition (noble metal alloys) of the bearing housings for removing heat by way of thermal conduction and convection, and do not typically provide any other method for removing heat from the bearing housing as the temperature limits of metals are much higher than non-metals like FRP.

Figure 7:
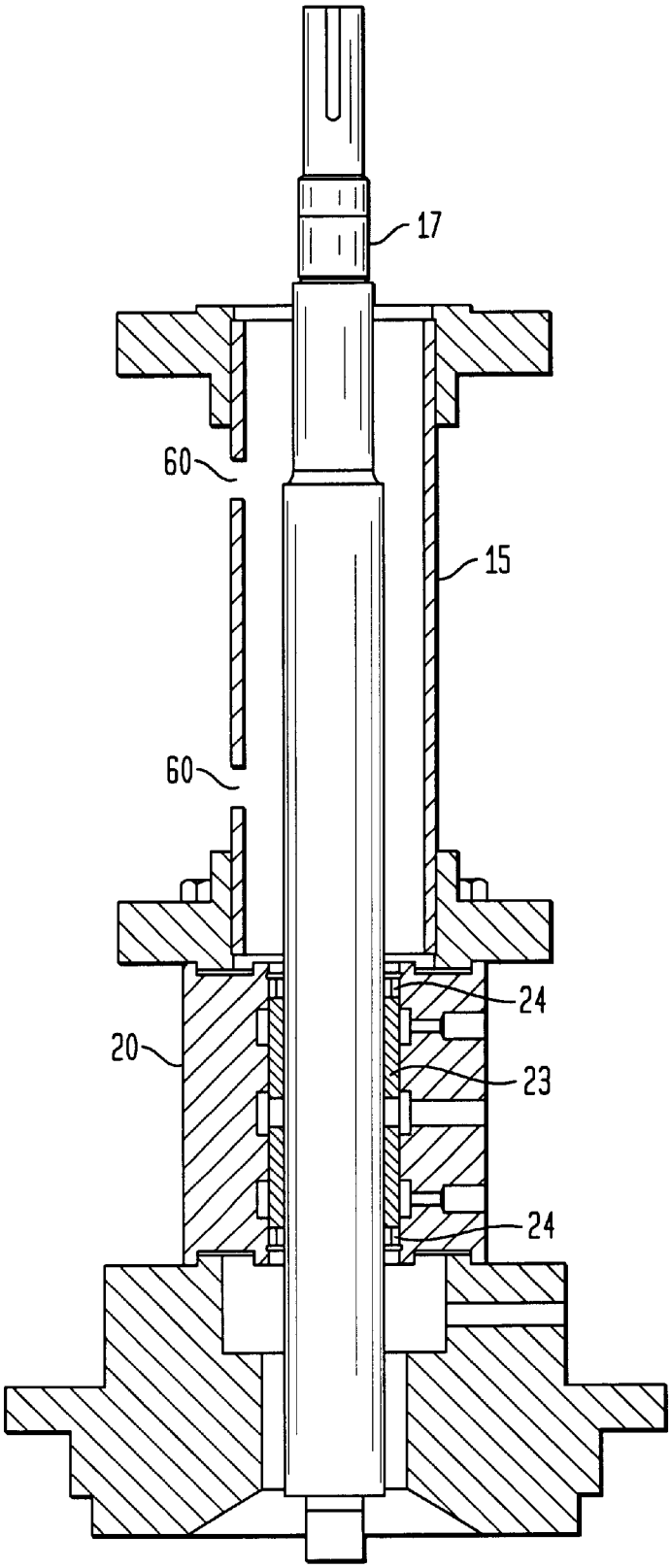
FIG. 7 is a partially sectioned elevational view of the column pipe and bearing assemblies.

FIG. 7 shows another aspect of the invention. More specifically a pair of spaced apart holes 60 are provided in the column pipe assembly 15 adjacent the top and bottom ends thereof. The holes 60 allow any pumped cooling liquid that may be forced up the column pipe assembly 15 by the pumping action of the impeller 18 (FIG. 1) to drain back into the sump thus, reducing the possibility of abrasive particles being forced through the grease seals 24 and damaging the seals 24, the bearing 23, and/or the drive shaft 17. The holes 60 also allow drainage of any pumpage that collects in the column pipe assembly 15 when the sump level is above the level of the holes 60 as is the case before the pump is energized to drain the sump.

It should now be apparent that the sealed steady bearing assembly 20 of the invention can be beneficially used in pump applications where it is desirable to exclude external environment, reduce or eliminate flushing/lubricating liquid, and prevent contaminants from being introduced into the bearing by the flushing liquid.

While the foregoing invention has been described with reference to the above embodiment, various modifications and changes can be made without departing from the spirit of the invention. Accordingly, all such modifications and changes are considered to be within the scope of the appended claims.

What is claimed is:

1. A bearing assembly for radially supporting a drive shaft of a pump, the bearing assembly comprising:

a bearing having inner and outer surfaces, the inner surface for lubricated contact with the drive shaft of the pump, the outer surface for coolant contact with cooling liquid;

a bearing housing for holding the bearing;

seals disposed in the housing, the seals for preventing entry of liquid in a space formed between the inner surface of the bearing and the drive shaft when the bearing assembly is assembled to the pump and for retaining a lubricant in the space; and at least one water jacket disposed about a portion of the outer surface of the bearing, the water jacket for circulating cooling liquid that contacts the outer surface of the bearing and carries away heat conducted through the bearing due to rotation of the drive shaft during operation of the pump.

2. The bearing assembly according to claim 1, wherein the bearing housing is composed of a corrosion resistant non-metallic material.

3. The bearing assembly according to claim 1, wherein the bearing is composed of carbon.

4. The bearing assembly according to claim 1, wherein the seals are adjacent each end of the bearing.

5. The bearing assembly according to claim 1, wherein the seals are composed of a corrosion resistant non-metallic material.

6. The bearing assembly according to claim 1, further comprising retainers for retaining the seals in the bearing housing.

7. The bearing assembly according to claim 6, wherein the retainers are composed of a corrosion resistant non-metallic material.

8. A pump comprising:

a pump assembly;

a motor and mounting assembly;

a drive shaft connecting the motor and mounting assembly to the pump assembly, the drive shaft enabling the motor and mounting assembly to drive the pump assembly when energized;

at least one bearing assembly for radially supporting the drive shaft, the at least one bearing assembly including:

a bearing housing;

a bearing disposed in the bearing housing, the bearing having inner and outer surfaces, the inner surface for lubricated contact with the drive shaft of the pump, the outer surface for coolant contact with cooling liquid;

seals disposed in the housing, for preventing entry of liquid in a space defined between the inner surface of the bearing and the drive shaft of the pump and for retaining a lubricant in the space; and at least one water jacket disposed about a portion of the outer surface of the bearing, the water jacket for circulating cooling liquid that contacts the outer surface of the bearing and carries away heat conducted through the bearing due to rotation of the drive shaft during operation of the pump.

9. The pump according to claim 8, wherein the bearing housing is composed of a corrosion resistant non-metallic material.

10. The pump according to claim 8, wherein the bearing is composed of carbon.

11. The pump according to claim 8, wherein the seals are adjacent each end of the bearing.

12. The pump according to claim 8, wherein the seals are composed of a corrosion resistant non-metallic material.

13. The pump according to claim 8, further comprising retainers for retaining the seals in the bearing housing.

14. The pump according to claim 13, wherein the retainers are composed of a corrosion resistant non-metallic material.

15. The pump according to claim 8, further comprising a column pipe assembly disposed between the motor and mounting assembly and the at least one bearing assembly.

16. The pump according to claim 8, wherein the column pipe assembly includes at least one hole for allowing cooling liquid forced up the column pipe assembly by the pumping action of the pump assembly to drain out of the column pipe assembly.

17. The pump according to claim 8, wherein the pump comprises a non-metallic, vertical sump and process pump.

18. The pump according to claim 8, further comprising a piping system for circulating pumped cooling liquid supplied from the pump assembly's discharge through the at least one water jacket.

19. The pump according to claim 18, wherein the piping system includes a discharge pipe, a flush spacer and internal tube flush assembly.

20. The pump according to claim 8, further comprising a lubricant pump for pumping lubricant into the space defined between the inner surface of the bearing and the drive shaft.

* * * * *